US006540375B1

(12) United States Patent
Levy et al.

(10) Patent No.: US 6,540,375 B1
(45) Date of Patent: Apr. 1, 2003

(54) NON-MECHANICAL CONTACT ACTUATOR FOR AN ARTICLE

(76) Inventors: Richard C. Levy, 6737 Newbold Dr., Bethesda, MD (US) 20817; Robert W. Jeffway, Jr., 37 Front St., Leeds, MA (US) 01053

( * ) Notice: Subject to any disclaimer, the term of this patent is extended or adjusted under 35 U.S.C. 154(b) by 0 days.

(21) Appl. No.: 09/949,818

(22) Filed: Sep. 12, 2001

(51) Int. Cl.[7] ..... F21L 4/04

(52) U.S. Cl. ..... 362/205; 362/112; 362/113; 362/114; 362/394; 362/802; 200/60; 200/61.02; 235/462.43

(58) Field of Search ..... 362/205, 112, 362/113, 114, 802, 394; 235/462.43; 200/60, 61.02

(56) References Cited

U.S. PATENT DOCUMENTS 3,214,507 A 10/1965 Williams
3,526,775 A 9/1970 Freidrich et al.
3,558,793 A 1/1971 Nakada et al.
4,134,223 A 1/1979 Hillenbrandt et al.
4,344,346 A 10/1982 Erickson et al.
4,429,607 A 2/1984 Meno
4,757,491 A 7/1988 Koike
4,757,629 A 7/1988 Austin
4,813,907 A 3/1989 Rissman et al.
4,968,877 A 11/1990 McAvinney et al.
5,081,896 A 1/1992 Hiyoshi et al.
5,637,996 A 6/1997 McDarren et al.
5,668,333 A 9/1997 Horton et al.
5,803,453 A 9/1998 Stephan et al.
6,202,930 B1 * 3/2001 Plesko ..... 235/462.43

* cited by examiner

*Primary Examiner*—Sandra O'Shea
*Assistant Examiner*— al. Tsidulko
(74) *Attorney, Agent, or Firm*—Nixon & Vanderhye

(57) ABSTRACT

A flashlight has a housing with a recess through which is passed a light beam from a light source to a light receiver. The receiver is coupled through a microprocessor to energize the bulb of the flashlight upon interruption of the light beam by an individual's finger or by a mechanical element movable between positions interrupting and not interrupting the light beam.

6 Claims, 6 Drawing Sheets

NON-MECHANICAL CONTACT ACTUATOR FOR AN ARTICLE

BACKGROUND OF THE INVENTION

The present invention relates to an actuator for an article and particularly to a non-mechanical actuator for actuating the article without physical contact between an individual finger and the article.

There are many types of articles which are actuated by a mechanical switching device, e.g. a trigger, requiring physical contact between a individual's index finger and the trigger per se typically to displace the trigger toward a hand grip. Examples of this type of trigger actuation include hand-held power tools, guns, electronic games, flashlights, to mention but a few. The present invention is primarily directed to weapons, for example, guns, particularly toy guns, as well as to flashlights and is described herein with reference to weapons or guns and flashlights. It will be appreciated, however, that the actuator, e.g., trigger hereof has diverse applicability to other types of articles requiring an actuator, such as those mentioned above and others.

In a typical weapon for example a hand gun, there is provided a hand grip, a barrel, and an actuator, e.g., a trigger assembly for firing the gun. The individual's hand conventionally extends or grasps about the handle grip and a portion of the individual's index finger is typically extended into a trigger guard housing a mechanical trigger. The individual's index finger is naturally positioned forwardly of the trigger and within the trigger guard by grasping the hand grip such that the index finger can be pulled back to displace the trigger and fire the weapon. In the toy or simulated weapons industry, a similar arrangement is conventionally provided. In both cases, the mechanical trigger is contacted by the individual's index finger and drawn back to fire or actuate the gun or toy weapon which then provides a sensory response. For example in the case of an actual hand gun, the firing of the gun is accompanied by an auditory signal that the gun has been fired. In the toy industry, various visual and auditory sensory responses are typically provided when the individual draws back the trigger. For example, sounds may be generated and emitted simulating the firing of a real gun. The sounds may be repeated simulating the firing of an automatic weapon. Other and different types of auditory sounds may be used.

Additionally, visual sensory responses for example the actuation of lights or the firing of a projectile such as the Nerf ball, dart or the projection of a stream water as in the case of a water gun, may be provided. It will be appreciated that there is a wide variety of auditory and/or visual sensory responses that can be generated using trigger assemblies in various environments. As additional examples, actuation of a trigger can control the movement of a toy race car. The handle of a toy sword can be provided with a trigger whereby the sword can generally project light or a light beam. Some machines, e.g., in amusement parks, often employ triggers to actuate or control a game. Trigger actuation is quite common for actuation of many different articles.

BRIEF SUMMARY OF THE INVENTION

In accordance with a preferred embodiment of the present invention, there is provided an actuator, e.g., a trigger for actuating an article affording a visual or auditory sensory response without mechanical contact between the individual's actuating finger and the mechanism. Particularly, and in a preferred embodiment of the present invention for use with a toy gun, a trigger zone is provided having forward and rearward trigger zone portions, preferably forwardly of a hand grip. The rearward zone portion lies between the forward zone portion and the hand grip in a location in which would otherwise typically lie an actuating trigger. In lieu of a mechanical trigger, a light source and light receiver are carried by the article. The light source projects a beam of light through the rear trigger zone portion for reception by the light receiver. Electronic means are provided coupled to the light receiver. The electronic means is responsive to interruption of the light beam by movement of an individual's finger from the forward trigger zone through the rearward trigger zone to provide a visual or auditory sensory response. The light beam, in effect, takes the place of the mechanical trigger. Preferably, the natural positioning of the individual's hand about the handgrip enables a natural positioning of the individual's index finger in the first trigger zone spaced from and preferably forwardly of the light beam and extending in a direction generally normal to a plane containing the hand grip and trigger zones. Consequently, the movement of the index finger in a direction toward the hand grip interrupts the visible light beam enabling a microprocessor forming part of the electronic means to provide an auditory and/or visual sensory response to the interruption of the beam. Additional sensory responses may be provided upon removal of the individual's finger reestablishing the light beam in the trigger zone. For example, the first auditory or visual sensory response may be turned off or turned off after a predetermined time period has elapsed. An additional light beam can also be provided to provide different auditory and/or visual sensory responses upon its interruption by the individual's finger. For example, interruption of the first light beam in a toy gun may simulate a single shot or a single firing of a water stream over a very short duration while interruption of the second light beam may simulate the sounds of automatic weapon fire or projection of a water stream over a longer period of time.

In another example, a flashlight typically has a on/off switch mounted on the housing operable to actuate the flashlight in response to finger-actuation of the switch moving the switch from an "off" position to an "on" position. The flashlight is typically turned off by finger-actuation of the switch from the "on" to the "off" position. In lieu of such mechanical switch, a light source and a light receiver are carried by the flashlight housing, preferably in a recess. As indicated previously,the light source projects a beam of light through the recess for reception by the light receiver. The light source is enabled by actuation of an electrical circuit providing power to the light source. Consequently, once the electrical circuit is enabled, an individual may interrupt the light beam by moving a finger into the recess thereby to actuate the flashlight. Upon removal of the individual's finger from the recess and enabling the projected light beam to be received by the receiver, the flashlight is turned off. The circuit enabling switch may then be opened to disable the circuit. Thus, an individual may, with the circuit enabled, actuate the flashlight, maintain the flashlight actuated or periodically: actuate and deactuate the flashlight by interrupting the beam of light. It will be appreciated that the reverse operation can also be accomplished. That is, the flashlight can be actuated when the circuit is enabled and the individual may inactivate the flashlight by interrupting the light beam.

In a preferred embodiment according to the present invention, there is provided a flashlight comprising a flashlight housing for containing at least one battery, a bulb and a flashlight actuation zone located along the housing, a light source and a light receiver carried by said housing, the light source projecting a beam of light through the actuation zone for reception by the light receiver and an electronic circuit coupled to the light receiver and responsive to interruption of the light beam to energize the bulb thereby actuating the flashlight.

BRIEF, DESCRIPTION OF THE DRAWINGS

DETAILED DESCRIPTION OF THE INVENTION

Figure 1:
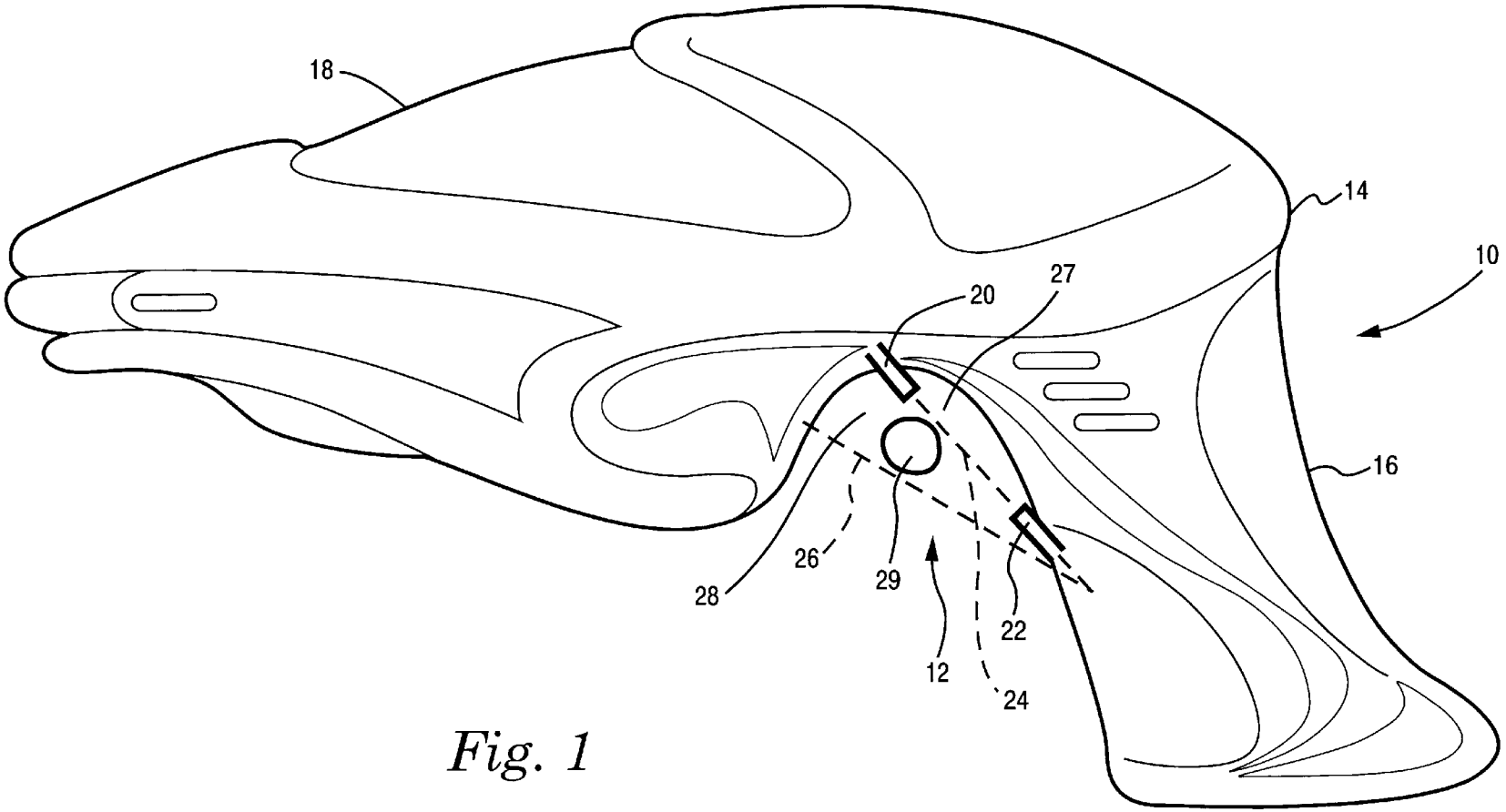
FIG. 1 is a schematic illustration of an article, e.g., a toy gun illustrating an actuator, e.g., a trigger, constructed according to a preferred embodiment of the present invention.
Figure 2:
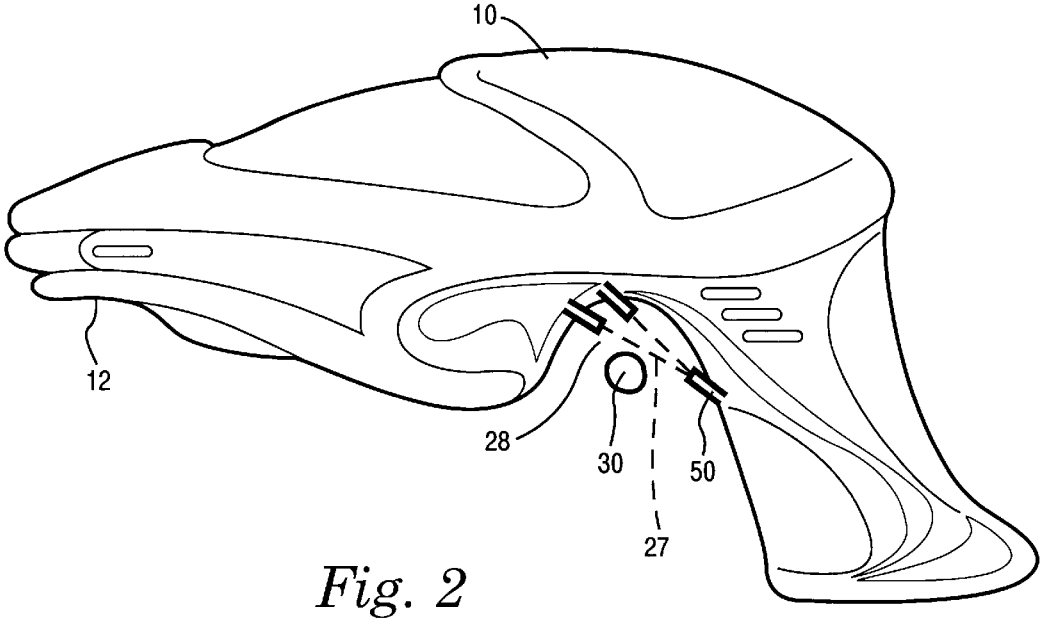
FIG. 2 is a schematic illustration of a further form of trigger hereof.
Figure 3:
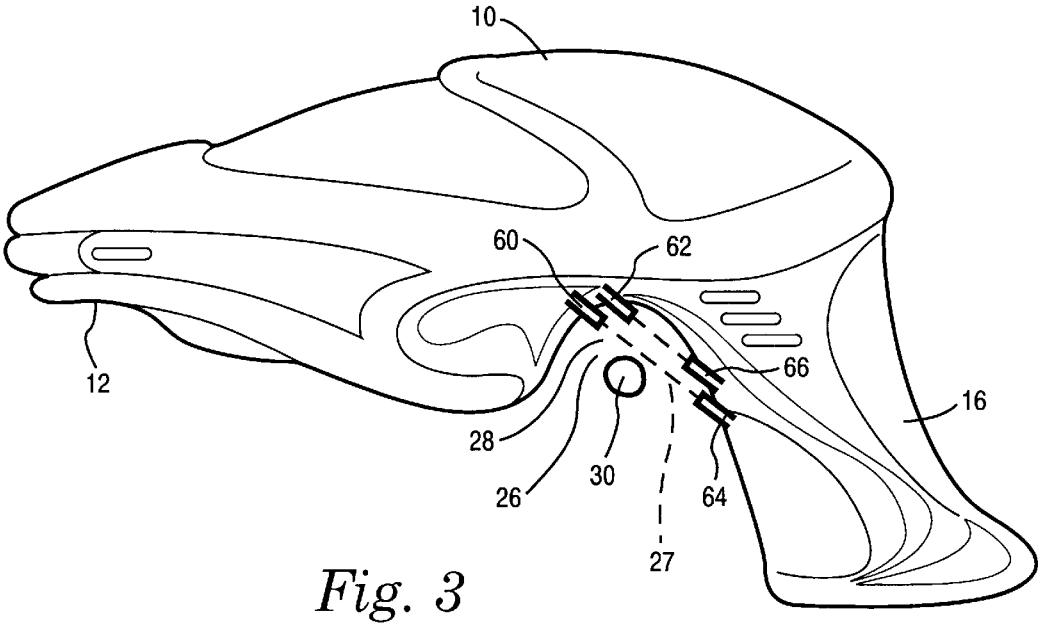
FIG. 3 is a view similar to FIG. 1 illustrating a still further form of the trigger.

Referring now to FIG. 1, there is illustrated an article generally designated 10 containing an actuator, e.g., a trigger, generally designated 12 constructed according with the present invention. The article 10 as illustrated in FIGS. 1–3 is in the form of a toy or simulated hand gun. However, it will be appreciated that the air trigger hereof has application to other types of articles, e.g., as noted above, including the toy sword of FIG. 5 and the flashlight of FIGS. 6–7. As illustrated in the embodiment of FIG. 1, the hand gun includes a gun frame 14 having a handle or hand grip 16 and a barrel 18 simulating an actual gun but which affords auditory and/or visual sensory perceptions when the trigger as explained below is activated.

The trigger 12 comprises, in the preferred form of the present invention illustrated in FIGS. 1–3, a light beam projected by a light emitting diode 20 onto a light receptor 22. As illustrated, the light emitting diode 20 is located along the gun frame 14 in the upper section of a trigger zone 26 and the light receptor 22 is located along the forward face of the handle 16. The light emitting diode 20 emits a light beam which is received by the light receptor 22. The beam of light indicated 24 may be visible or invisible light, such as infrared, and traverses a rearward trigger zone portion 27 of trigger zone 26. A forward trigger zone portion 28 lies in the trigger zone 26 forwardly of the rearward trigger zone portion 27 and in a plane common to the trigger zone portion 27 and handle 16. It will be appreciated that the trigger zone 26 generally conforms to the trigger area of a conventional hand gun but as illustrated does not have a mechanical trigger or any other physical parts in that zone. The forward trigger zone portion 28 is that portion of the trigger zone in which an individual's index finger will naturally extend or reside when grasping his/her hand about the handle 16. That is, when the individual's hand is extended about the handle 16, the natural positioning of the individual's index finger is in the first or forward trigger zone portion spaced forwardly of the visible light beam 24. Note that the individual's index finger lies in this natural position (represented by the circle 29 in drawing FIG. 1) when the individual's hand grasps naturally about the hand grip 16.

It will be appreciated that the actuation of an article, e.g., the simulated firing of a toy gun, is accomplished by pulling back the individual's index finger 30 to interrupt the light beam 24 between the light emitting diode 20 and the light receiver 22. This is identical to the individual's action when pulling back a trigger where physical contact occurs between the individual's index finger and an actual mechanical trigger. As explained below, the interruption of the light beam causes auditory and/or visual sensory responses indicating activation of the article. For example, interruption of the light beam by "firing" the gun may cause a discrete sound simulative of an actual firing of a gun or may cause a mechanism of the gun, not shown, to shoot a dart, activate a water gun, project a light beam or the like. It will be appreciated that a wide variety of responses to the passage of the individual's finger from the forward trigger zone portion into the rearward trigger zone portion interrupting the light beam can be provided. Other types of responses, e.g., might be the actuation of a visible indicator light. Various combinations of light and sound effects can also be provided as those skilled in the art will recognize.

Figure 4:
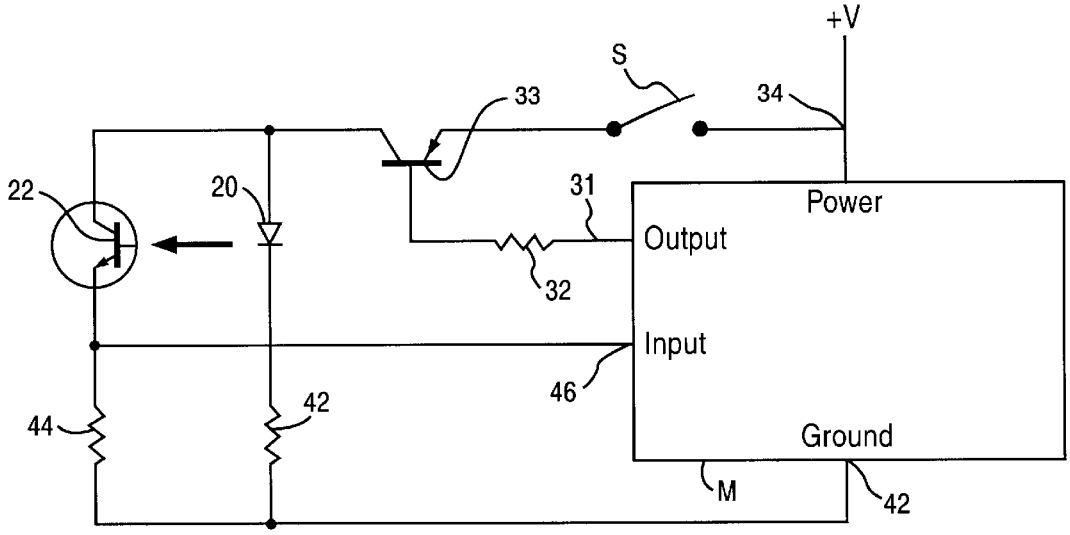
FIG. 4 is a schematic representation of electronic circuitry for providing auditory or visual sensory responses upon enabling of the circuits and actuation of the actuator.

Referring to FIG. 4, there is illustrated an electronic circuit for enabling the actuator, e.g., trigger, and providing a response to actuation of the trigger. Particularly, in the circuit illustrated in FIG. 4, there is provided a toggle switch S which may be depressed into a first state to provide an air trigger enable signal 31 from a microprocessor M connected to the base of a PNP transistor 33 through resistor 32. The emitter of transistor 33 is connected to +voltage at 34. The collector of transistor 33 is connected to the collector of the light receiver, e.g., photo transistor 22 and to the anode of the LED 20. The cathode of the LED 20 is connected to ground through resistor 42. The emitter of the photo transistor 22 is connected to ground through resistor 44. The emitter of photo transistor 22 is also connected to the trigger input signal at 46 in the microprocessor M.

When the trigger circuit is enabled by closing toggle switch S to its first state, the air trigger enable signal 31 in the microprocessor M outputs a current through resistor 32 into the base of PNP transistor 33. Transistor 33 is thus turned on with this base current thereby connecting power 34 to the collector of photo transistor 22 and to the anode of LED 20. When transistor 33 is turned on, the LED 20 emits a beam of light that is sensed by the photo transistor 22. The beam of light may be of any color, e.g., red, orange, yellow, green or the like and may be a visible or invisible light beam. The light emitted from the LED 20 that is sensed by photo transistor 22 turns on the base of photo transistor 22 thereby permitting a current flow through photo transistor 22. The current flow through transistor 22, at least partially flows through resistor 44, thereby forcing the voltage at the emitter of photo transistor 22 to a first voltage level. This voltage is sensed by the actuator, e.g., trigger input signal 46 of microprocessor M. When the light from the LED is interrupted or blocked, the current into the base of photo transistor 22 is turned off. Thus, no current flows through photo transistor 22 and the voltage at the emitter photo transistor 22 becomes the voltage at ground. This voltage state is detected by the microprocessor M at trigger input 46 and auditory and/or visual sensory responses are provided for example using a sound chip. When the trigger circuit is not enabled, such as when the toy is "off," by opening switch S, i.e., toggling switch S to a second state, no current is output to the base of transistor 33 via resistor 32, thereby effectively disconnecting the power source at 34 from the collector of photo transistor 22 and the anode of the LED 33. In this state, the circuit is effectively disabled. When the trigger circuit is enabled, a current is applied to the base of transistor 33. In this state, the power output at 34 is electrically connected to both the collector or photo transistor 22 and the anode of the LED 20.

Referring to FIG. 2, there is illustrated another form of an air trigger according to the preferred embodiment of the present invention for use with a toy gun. In this form, the gun frame mounts the light emitting diode 20 and the light receiving photo transistor 22 on the same side of the second trigger zone. A light reflector 50 is disposed at the opposite side of the second or rearward trigger zone portion 27. Thus the light emitted from the light emitting diode 20 forms a light beam directed to the reflector 50 and the reflector 50 reflects the light beam to the photo transistor 22 found adjacent the light emitting diode 20. Thus a pair of beams span the rearward trigger zone portion 27, interruption of one of which provides the aforementioned response in the trigger circuit.

Referring to FIG. 3, a pair of light emitting diodes 60 and 62 are mounted along the same side of the second trigger zone. A pair of light receiving photo transistors 64 and 66 are mounted adjacent the opposite side of the second trigger zone preferably colored. Accordingly when an individual trigger circuit is enabled, a pair of visible light beams extend across the second trigger zone portion 27 as illustrated by the dashed lines. The circuitry illustrated in FIG. 4 may be repeated with respect to the second LED and second light receiver. Different responses can be provided in response to interruption of the pair of beams. For example, when the trigger finger is moved rearwardly to interrupt the light beam first encountered in the second trigger zone portion 27, the response may be a single action for example a single auditory noise or the rapid actuation/deactuation of a light. When the finger interrupts the second beam, a continues reaction may be provided. For example a continuous noise may be heard or the light is maintained in an on condition until the finger is removed from the second trigger zone portion reinstating the second beam without interruption.

Figure 5:
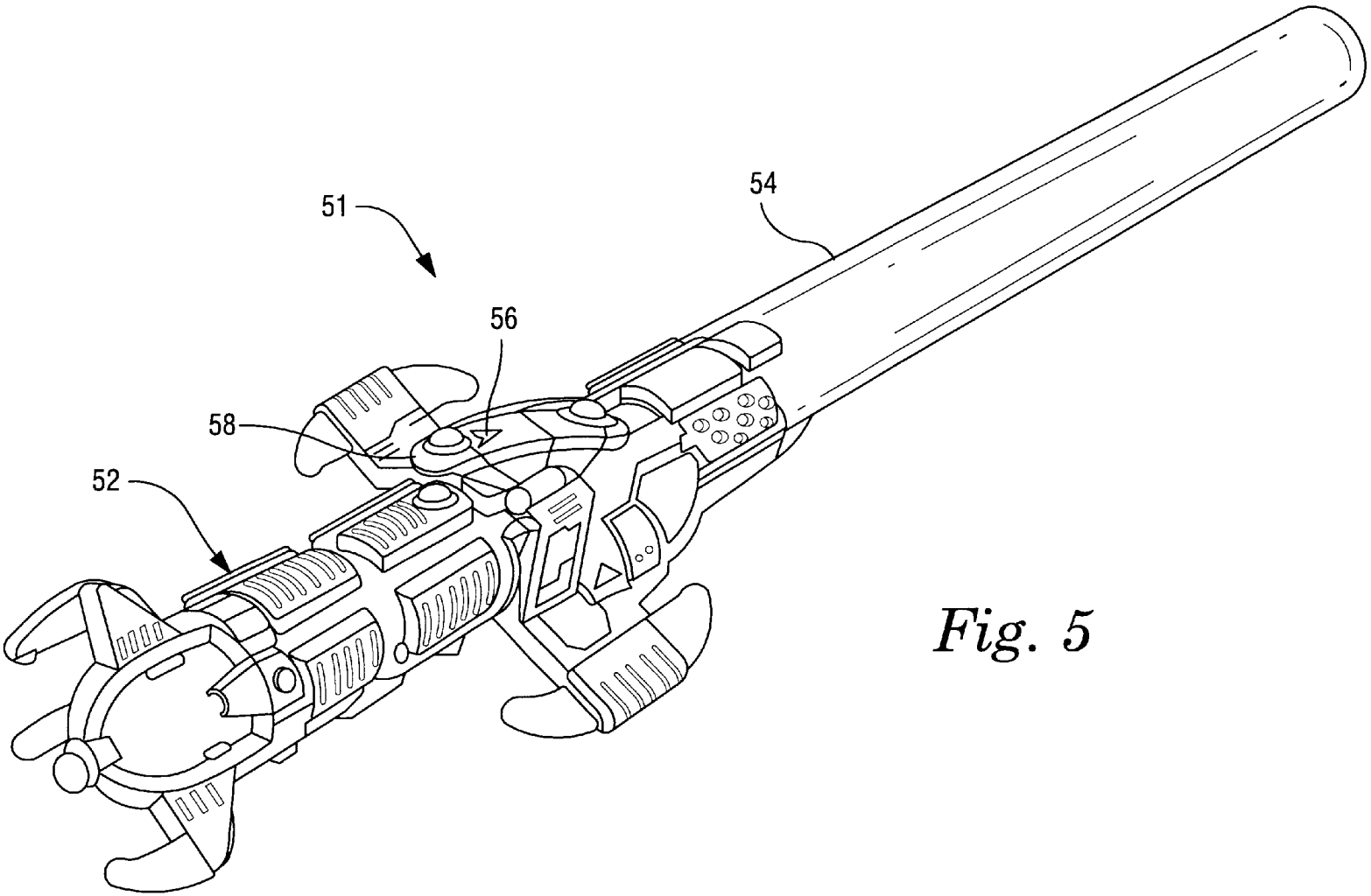
FIG. 5 is a schematic representation of a sword incorporating a trigger constructed in accordance with a preferred embodiment of the present invention.

Referring to FIG. 5, there is illustrated a sword, generally designated 51, having a handle 52 and a simulated blade 54. The handle includes a guard 56 which is spaced laterally of the forward portion of the handle 52. The guard 56 and the forward portion of the handle spaced from and underlying the guard 56 mount one or the other of the light-emitting diode and light receptor, respectively. For example, a light-emitting diode similar to diode 20 of an earlier embodiment may be provided at the distal end 58 of the guard 56. Underlying the distal end 58 and on the forward portion of the handle 52 spaced from distal end 58, there is provided a light receptor similar to the light receptor 22 of the earlier embodiment.

The sword 51 may be provided with various visual or auditory responses, or both, upon actuation of the trigger. For example, one or more portions of the sword may light up or glow upon trigger actuation. The user of the sword 51 thus can grasp the sword by the handle 52 and insert a digit, i.e., a finger, between the distal end 58 of the guard 56 and the forward portion of the handle 52, interrupting the light beam which, through a circuit, for example, as illustrated in FIG. 4, actuates the visual or auditory responses, or both. Thus, it will be appreciated that the distal portion 58 and the forward portion of handle 52 constitute a trigger zone having first and second trigger zone portions spaced one from the other, affording a light beam therebetween which, if interrupted by insertion of an individual's finger, actuates the sensor in response.

Figure 6:
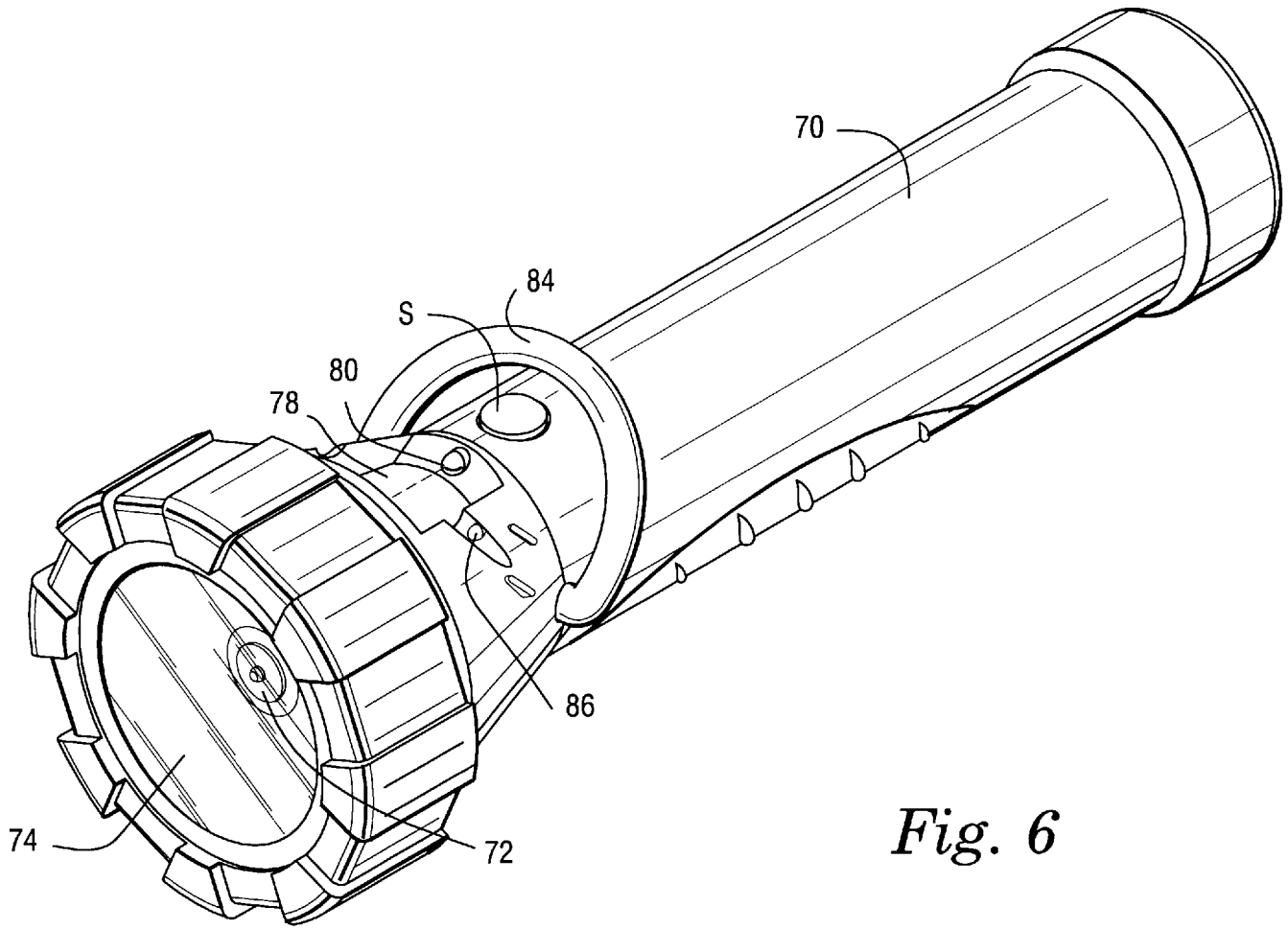
FIG. 6 is a perspective view of a flashlight employing a non-mechanical contact actuator therefor in accordance with another embodiment of the present invention.
Figure 7:
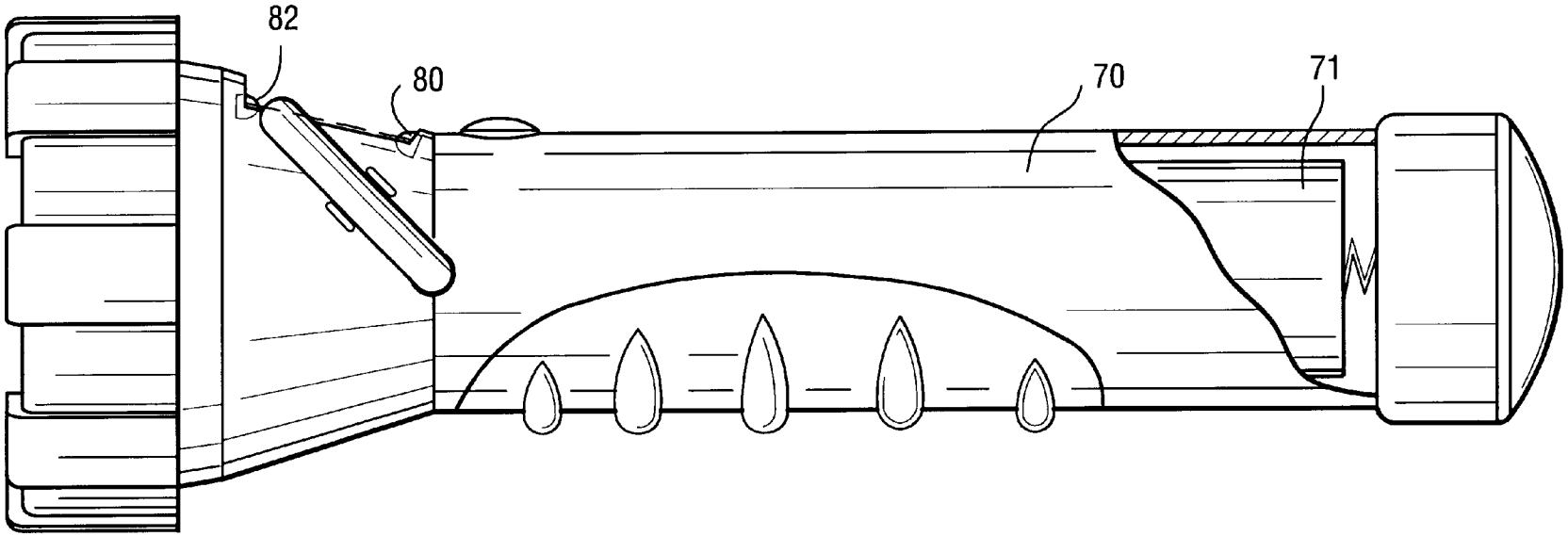
FIG. 7 is a side elevational view of the flashlight illustrated in FIG. 6.

Referring to FIGS. 6 and 7, there is illustrated a further embodiment of the present invention wherein the air actuator or trigger hereof is adapted for use with a flashlight. As will be appreciated, the flashlight includes a housing 70 containing a plurality Qf batteries 71 for powering a bulb 72 for shining a beam of light through a lens 74 at one end of the flashlight. The mechanical features of a flashlight are well known and further description thereof is not necessary. Suffice to say that the circuit illustrated in FIG. 4 may also be applicable to the flashlight 70 of FIGS. 6 and 7. Thus, the flashlight is provided with an enabling switch S which enables the circuit illustrated in FIG. 4.

The flashlight 70, however, also includes a recess 78 at a location for easy access to an individual's finger, e.g., a thumb. Mounted within the recess is a light-emitting diode 80 similar to diode 20, as well as a light receptor 82 similar to the light receptor 22 of the previous embodiments. As described previously, the light-emitting diode 80 emits a light beam which is received by the light receptor 78 and which light beam may be visible or invisible light. Also, a lever 84 may be pivotally mounted on the housing of the flashlight for movement between a rest position illustrated in FIG. 6 and a position in FIG. 7 in which a portion of the receiver is received in recess 78, interrupting the light beam, for reasons described below.

In operation, the toggle switch S is depressed to enable the electronic circuit illustrated in FIG. 4, thus, connecting the power 34 to the LED 80. LED 80 then emits a light beam across the recess 78 for reception by the receiver 82. Consequently, when the individual inserts a finger, e.g., a thumb, into the recess, blocking the beam of light, the current into the base of phototransistor 22 is turned off and no current flows through the transistor 22, causing the voltage at the emitter phototransistor 22 becomes the voltage at ground. This voltage state is detected by the microprocessor M and a circuit is completed to actuate the bulb 72.

When a trigger circuit is not enabled, such as when the flashlight is turned off by displacing toggle switch S to its second state, no current is output to the base of transistor 33 via resistor 32, thereby effectively disconnecting the power source at 34 from the collector of phototransistor 22 in the anode of the LED. In this state, the circuit is effectively disabled.

In order to maintain the flashlight in an "on" condition, after the circuit has been enabled, the lever 84 may be pivoted to a position where a portion of the lever lies within the recess 78, interrupting the light beam. Consequently, with the light beam interrupted, the flashlight remains on with the bulb actuated. Upon pivoting the lever to the position illustrated in FIG. 6, the light beam is uninterrupted, maintaining the circuit in a condition ready to actuate the bulb upon interruption of the light beam assuming the circuit is enabled with toggle switch S closed. The sides of recess 78 may have detents 86 for maintaining the lever 84 in position interrupting the light beam.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A flashlight comprising:

a flashlight housing for containing at least one battery, a bulb and a flashlight actuation zone located along said housing;

a light source and a light receiver carried by said housing, said light source projecting a beam of light through the actuation zone for reception by said light receiver; and an electronic circuit coupled to said light receiver and responsive to interruption of the light beam to energize the bulb thereby actuating the flashlight;

said electronic circuit including a microprocessor for processing a signal from said light receiver upon interruption of the light beam for actuating the flashlight.

2. A flashlight comprising:

a flashlight housing for containing at least one battery, a bulb and a flashlight actuation zone located along said housing;

a light source and a light receiver carried by said housing, said light source projecting a beam of light through the actuation zone for reception by said light receiver; and an electronic circuit coupled to said light receiver and responsive to interruption of the light beam to energize the bulb thereby actuating the flashlight;

said electronic circuit including a microprocessor for processing a signal from said light receiver upon removal of the interruption of the light beam for deactuating the flashlight.

3. A flashlight comprising:

a flashlight housing for containing at least one battery, a bulb and a flashlight actuation zone located along said housing;

a light source and a light receiver carried by said housing, said light source projecting a beam of light through the actuation zone for reception by said light receiver; and an electronic circuit coupled to said light receiver and responsive to interruption of the light beam to energize the bulb thereby actuating the flashlight;

said housing including a recess opening outwardly thereof, said light source and said light receiver being carried by said housing such that the beam of light passes through said recess from said light source to said light receiver.

4. A flashlight according to claim 3 including an access opening to said recess to enable an individual to insert a finger into the recess to interrupt the light beam.

5. A flashlight according to claim 3 including a bracket mounted on said housing movable between a first position remote from said light beam and a second position in said recess, interrupting the light beam.

6. A flashlight according to claim 5 wherein said bracket includes a pivoted lever.

* * * * *